US011078070B2

(12) United States Patent
Wolfson

(10) Patent No.: US 11,078,070 B2
(45) Date of Patent: Aug. 3, 2021

(54) AUTOMATIC ASSEMBLY OF GLUELESS POCKETED SPRING UNITS

(71) Applicant: Martin Wolfson, Dallas, TX (US)

(72) Inventor: Martin Wolfson, Dallas, TX (US)

( * ) Notice: Subject to any disclaimer, the term of this patent is extended or adjusted under 35 U.S.C. 154(b) by 0 days.

(21) Appl. No.: 15/864,576

(22) Filed: Jan. 8, 2018

(65) Prior Publication Data

US 2019/0055115 A1 Feb. 21, 2019

Related U.S. Application Data

(60) Provisional application No. 62/446,845, filed on Jan. 17, 2017.

(51) Int. Cl.

| | |
|---|---|
| ***B68G 9/00*** | (2006.01) |
| ***A47C 27/06*** | (2006.01) |
| ***B68G 15/00*** | (2006.01) |
| ***A47C 27/07*** | (2006.01) |

(52) U.S. Cl.

CPC ..... *B68G 9/00* (2013.01); *A47C 27/064* (2013.01); *A47C 27/07* (2013.01); *B68G 15/00* (2013.01)

(58) Field of Classification Search

CPC ..... B68G 9/00; B68G 15/00; B29C 65/088; A47C 27/06

See application file for complete search history.

(56) References Cited

U.S. PATENT DOCUMENTS

| | | | | |
|---|---|---|---|---|
| 3,193,136 | A * | 7/1965 | Stumpf | B21F 33/04 221/40 |
| 4,401,501 | A * | 8/1983 | Stumpf | B68G 9/00 156/182 |
| 4,566,926 | A * | 1/1986 | Stumpf | A47C 27/063 156/165 |
| 5,792,309 | A * | 8/1998 | Eto | B68G 9/00 140/3 CA |
| 6,159,319 | A * | 12/2000 | Mossbeck | A47C 27/064 156/182 |
| 7,211,167 | B1 * | 5/2007 | Whitworth | B68G 9/00 118/220 |
| 8,402,642 | B2 * | 3/2013 | Kujuro | B68G 9/00 156/264 |
| 9,221,671 | B2 * | 12/2015 | Wolfson | A47C 27/07 |
| 9,427,093 | B2 * | 8/2016 | Wolfson | A47C 27/07 |
| 2016/0007761 | A1 * | 1/2016 | Wolfson | B29C 65/229 267/142 |

* cited by examiner

*Primary Examiner* — Ryan J. Walters
*Assistant Examiner* — Michael W Hotchkiss
(74) *Attorney, Agent, or Firm* — Seth A. Horwitz; Carrington, Coleman, Sloman & Blumenthal, L.L.P.

(57) ABSTRACT

Methods and systems for no-glue pocketed spring unit construction. Rows of pocketed springs modules, comprising more than two pocketed springs surrounding a central hole, can be automatically loaded onto an assembler; pocketed spring-surrounded openings can be automatically aligned with welding phalanges; and probe/anvil welding pairs can be inserted into modules in different rows of modules, closed around polymer pocket fabric, and activated to weld rows of modules together without glue; without a user manually loading rows of modules onto the assembler.

20 Claims, 11 Drawing Sheets

AUTOMATIC ASSEMBLY OF GLUELESS POCKETED SPRING UNITS

CROSS-REFERENCE

This application is a non-provisional of, and claims priority from, U.S. Provisional App. No. 62/446,845, filed on Jan. 17, 2017, which is hereby incorporated by reference.

BACKGROUND

The present application relates to methods, devices and systems for automatic no-glue construction of pocketed inner spring units, and more particularly to automatic loading, alignment and welding of rows of pocketed spring modules to construct glueless pocketed inner spring cushioning units.

Note that the points discussed below may reflect the hindsight gained from the disclosed inventive scope, and are not necessarily admitted to be prior art.

Connecting rows of pocketed springs together using a scrim sheet generally causes a trampoline-like effect, i.e., compressing springs in one part of the unit pulls on another part of the unit.

Glue connections between pocketed springs generally provide a "crunchier" feeling to a completed pocketed spring unit than connections made by thermal welding of polymeric pocket fabric.

SUMMARY

The inventor has discovered new approaches to methods, devices and systems for manufacturing glueless pocketed spring cushioning units for use in mattresses and other cushioning assemblies.

Pocket spring modules comprise more than two pocketed springs welded together to surround and define a central opening. Cushioning units are manufactured using rows of linearly connected pocketed spring modules, preferably manufactured from rows of pocketed springs welded together between alternating pairs of pocket springs. Rows of modules are loaded onto a cushioning unit assembler, and module openings are aligned with rows of welding phalanges (akin to fingers). Welding phalanges are then inserted into the module openings. Pairs of welding phalanges, inserted into pairs of modules in different rows of modules, are then closed together and activated to form welds.

In a preferred embodiment, a method for assembling a cushioning unit comprises the steps of: automatically aligning, using multiple positioning rods inserted between pairs of adjacent ones of said modules in a linearly connected row of said modules, a main axis of said openings of said row of modules with a main axis of welding phalanges in a row of welding phalanges; inserting said welding phalanges into said aligned openings, and inserting another row of welding phalanges into said openings of another row of modules which is adjacent and parallel to said row of modules; and closing together said rows of welding phalanges, and activating ones of said welding phalanges to thereby weld together said rows of modules.

In other preferred embodiments, a method for assembling a cushioning unit comprises the steps of: a) activating a first and second row of welding phalanges, respectively inserted in said openings in first and another rows of modules and closed together, to weld together said first and another rows of modules; b) loading a second row of modules into parallel and adjacent contact with said first row of modules; c) after step b), separating said rows of welding phalanges and removing said welding phalanges from said first and another rows of modules; d) moving said second row of modules to enable insertion of said first row of welding phalanges into said openings in said second row of modules, and moving said first row of modules to enable insertion of said second row of welding phalanges into said openings in said first row of modules; and e) inserting said first row of welding phalanges into said openings in said second row of modules, and inserting said second row of welding phalanges into said openings of said first row of modules, and activating said welding phalanges to weld said first and second rows of modules together.

Numerous other inventive aspects are also disclosed and claimed.

BRIEF DESCRIPTION OF THE DRAWINGS

The disclosed inventive scope will be described with reference to the accompanying drawings, which show important sample embodiments and which are incorporated in the specification hereof by reference, wherein.

DETAILED DESCRIPTION OF SAMPLE EMBODIMENTS

The numerous innovative teachings of the present application will be described with particular reference to presently preferred embodiments (by way of example, and not of limitation). The present application broadly describes inventive scope, and none of the statements below should be taken as limiting the claims generally.

In particular, the inventor has discovered how to construct an automatic cushioning unit assembler which can automatically (without an operator loading or aligning pocketed springs) manufacture pocketed spring cushioning units (generally, rectangular arrays of pocketed springs). Cushioning units can then be padded with upholstery and wrapped with a fabric cover to manufacture a cushioning structure incorporating pocketed springs, e.g., a mattress, couch or cushion.

Pocketed springs comprise springs in a pocket of a flexible, preferably polymeric fabric (typically plastic). Pocketed spring modules comprise more than two pocketed springs welded together to surround and define a central opening. Cushioning units are manufactured using rows of linearly connected pocketed spring modules, preferably manufactured from rows of pocketed springs thermally welded together between alternating pairs of pocket springs.

Figure 1A:
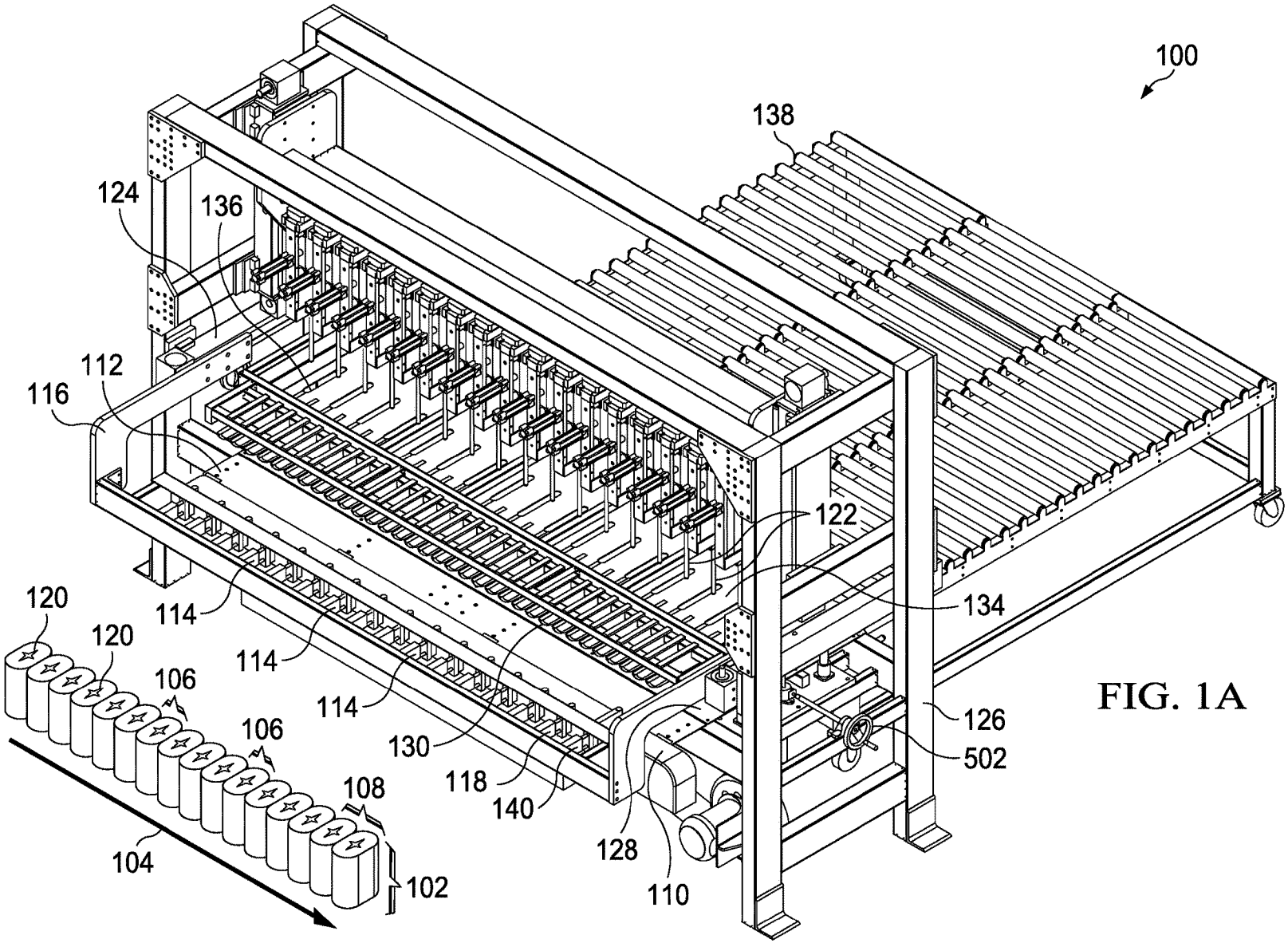
FIG. 1A schematically shows an example of a machine for welding rows of pocketed spring modules to each other.

The broad outlines of a loading and welding process can be summarized as follows. Referring to FIG. 1A, rows of modules 102 are loaded onto a cushioning unit assembler 100 from left to right (for example) on a conveyor belt 110. The modules are then moved front-ward (defined below) through the cushioning unit assembler 100 towards a front-ward row of welding phalanges 122 (akin to fingers). Preferably, the cushioning unit comprises a front-ward row of welding phalanges 122 and a rear-ward row of welding phalanges 122. Generally, a row of modules 102 will already be present under the rear-ward row of welding phalanges 122 (previously welded to a currently-being-fabricated cushioning unit) when the row of modules 102 currently being loaded arrives under the front-ward row of welding phalanges 122. The front-ward and rear-ward rows of welding phalanges 122 are then inserted into the central openings 120 of respective rows of modules 102. Pairs of welding phalanges 122, inserted into pairs of modules in different rows of modules, are then closed together and activated to form thermal welds. This process can be repeated for additional rows of modules 102 to form a completed cushioning unit.

A row of modules can be automatically positioned for welding by loading it onto the cushioning unit assembler using a conveyor belt, and spacing and aligning the row of modules using positioning rods sequentially inserted between adjacent pairs of modules while the conveyor belt is run in reverse to separate the modules (applies tension to pull them away from each other) and expand the modules' central openings.

The inventor has also discovered that weld strength and reliability can be improved if the welding phalanges are not separated and extracted from a previously-welded pair of rows of modules until a newly loaded row of modules is pressed against one of the just-welded rows of modules. This gives welds time to cool, and holds welds together while the welding phalanges are extracted.

Specific directions (e.g., front, rear, left and right) are merely exemplary, are used solely to facilitate understanding of exemplary embodiments, and are in no way intended to limit disclosed inventive scope.

The disclosed innovations, in various embodiments, provide one or more of at least the following advantages. However, not all of these advantages result from every one of the innovations disclosed, and this list of advantages does not limit the variously claimed inventive scope.

- Fast pocketed spring unit assembly using NO GLUE;
- pocketed spring units, and cushioning assemblies incorporating pocketed spring units, are more comfortable and luxurious-feeling;
- lowered labor cost for no-glue pocketed spring unit assembly;
- reduced total cost for no-glue pocketed spring unit assembly;
- enables high throughput of no-glue pocketed spring unit assembly;
- cost-effective welding of entire rows of pocketed springs;
- stronger connections between rows of pocketed springs;
- reduced likelihood of unmoored pockets;
- reduced likelihood of loose springs;
- reduced environmental impact of pocketed spring unit construction;
- reduced environmental impact of cushioning assembly construction and maintenance;
- rows of pocketed springs can be fully welded together in a single weld event, with controllable vertical weld location, extent, width, and strength;
- reduced weight of pocketed spring unit;
- reduced weight of cushioning assembly;
- lower cushioning assembly transportation cost per unit;
- increased cushioning unit durability.

Some exemplary parameters will be given to illustrate the relations between these and other parameters. However it will be understood by a person of ordinary skill in the art that these values are merely illustrative, and will be modified by scaling of further device generations, and will be further modified to adapt to different materials or architectures if used.

The inventor has discovered new approaches to methods and systems for manufacturing glueless pocketed spring cushioning units for use in mattresses and other cushioning assemblies. Rapid, efficient, easily maintainable and fully automated methods and systems for cushioning unit assembly are enabled and supported by accurate and automated loading and positioning of rows of pocketed spring modules.

"Cushioning assembly" is defined herein as any cushioning structure incorporating pocketed springs, e.g., a mattress, couch or cushion. "Cushioning unit" or "pocketed spring unit" is defined herein as an assembly of pocketed springs used to manufacture a cushioning assembly (e.g., by padding the cushioning unit with upholstery and wrapping it with a fabric cover).

In preferred embodiments, pockets are formed gluelessly by welding together layers of a flexible material, generally plastic, such as spun bonded polypropylene (typically a lightweight material, e.g., 1.5 ounces per square yard), using Joule heating effected by current passed through a heating element compressed against the fabric. By forming pockets of a chosen size on a chosen length and width of fabric, rows of pockets of a chosen length and sized for a chosen diameter and length of spring can be produced.

In preferred embodiments, uniform diameter springs are used. Uniform diameter springs can be manufactured by custom winding high tensile strength wire with highly uniform shape and thickness.

Some embodiments use or include microcoil springs, which are small springs suitable for use in pocketed spring units incorporated into, for example, upholstery.

Springs are inserted into pockets to form pocketed springs. Springs can be inserted into pockets oriented horizontally through a seam on top of the pocket, and then beaten until they reorient vertically. Generally, this results in a pocketed spring that, in a completed cushioning assembly, can only be oriented in a single direction. For example, a bed made in this way is typically called "one sided".

Preferably, springs are inserted oriented vertically through a seam on the side and allowed to expand to fill the pocket. A central seam can be formed as disclosed in U.S. Pat. No. 6,131,892, and insertion through such a seam can be performed as disclosed in U.S. Pat. No. 6,260,331, both of which are incorporated herein by reference.

Pockets can be fashioned to be shorter than an uncompressed spring, so that pocketed springs are constantly under load ("preloaded"). This generally increases the useful lifetime of the spring, by allowing its spring constant to remain higher, for longer. Preloaded springs are generally inserted vertically compressed, and allowed to expand vertically to fill the pocket.

A row of pocketed springs, in which pocketed springs are connected to adjacent pocketed springs (e.g., by the same fabric that forms the pockets) can be formed as shown and described in, for example, U.S. Pat. No. 6,131,892.

Figure 1B:
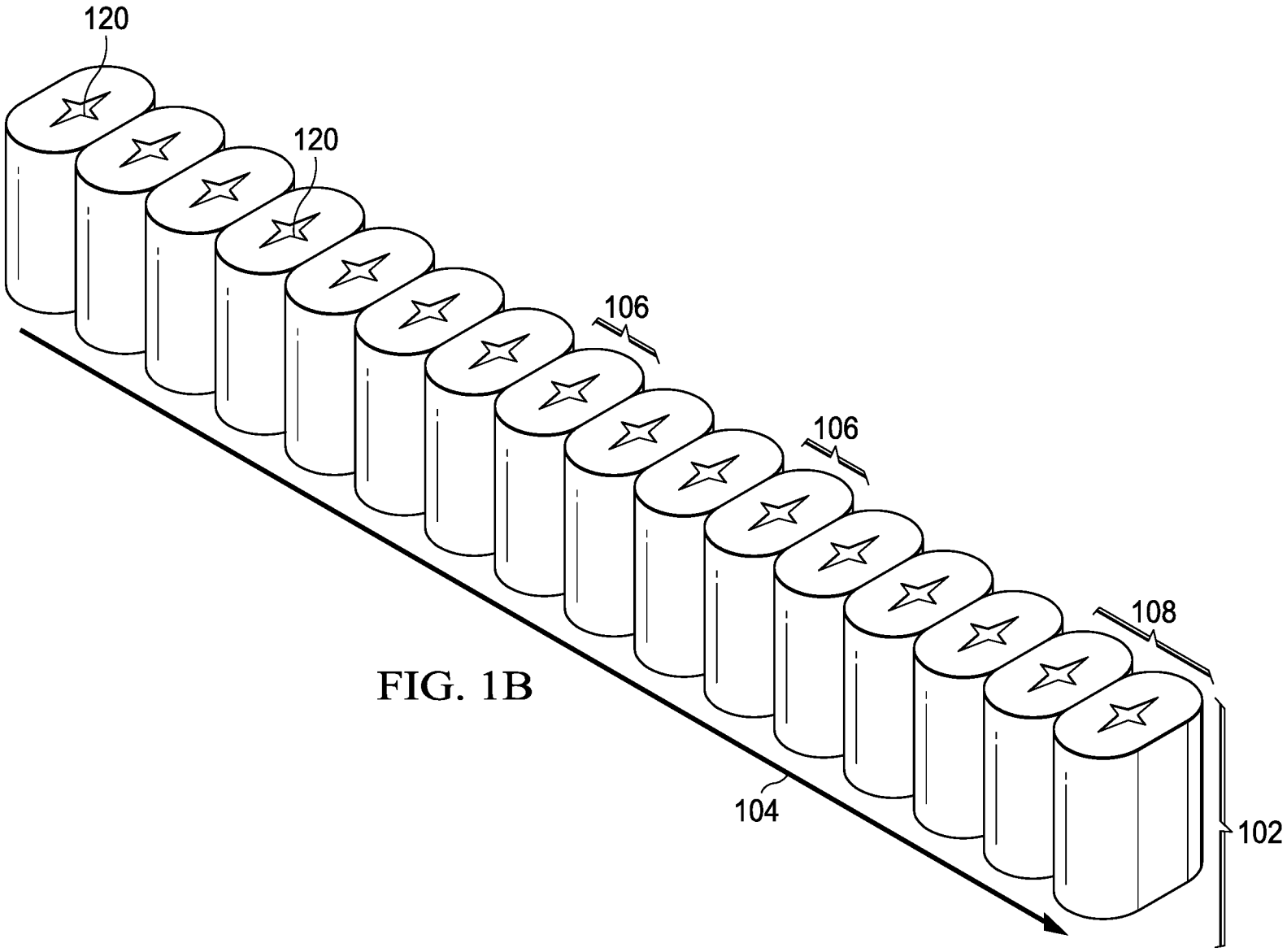
FIG. 1B schematically shows an example of a row of multi-pocket modules.

Rows of pocketed springs can be fashioned into rows of multi-pocket "modules" 102 (comprising linearly connected "pocketed spring modules" 106) as shown in FIG. 1B. Individual modules 106 comprise more than two—preferably, four—pockets welded together to leave a central opening 120 (a hole) in the middle. Preferably, rows of modules 102 are formed by welding two rows of pocketed springs together (e.g., a row of pocketed springs folded in half), with welds between alternating pairs of pocketed springs. For example, for consecutive pocketed springs 1-2-3-4 in a row of pocketed springs, there will preferably be a weld between pocketed springs 1 and 2, no weld between pocketed springs 2 and 3, and a weld between pocketed springs 3 and 4. An end of a row of modules 102 preferably terminates in a weld, or in continuous fabric corresponding to the row of pocketed springs having been folded in half (against itself), with fabric between pairs of pocketed springs on one side of the fold welded to fabric between pairs of pocketed springs on the other side of the fold, to produce the row of modules 102.

Rows of modules 102 can be welded together (e.g., serially) to form pocketed spring units. Rows of pocketed spring modules 102 can be assembled as shown and described in, for example, U.S. Pat. No. 6,347,423, which is incorporated herein by reference. Preferably, central openings 120 have uniform spacing from each other. This can be accomplished by, e.g., nearest-adjacent (not catty-corner) springs in modules 106 having uniform spacing from each other, and modules 106 in a row of modules 102 having uniform spacing from each other.

Multiple horizontally-adjacent rows of pocketed springs can be connected together to form pocketed spring cushioning units. Generally, pocketed spring units look like (typically rectangular) arrays of pocketed springs from above.

Springs in completed pocketed spring units are typically compressed very flat and rolled up into tight cylinders for shipping.

Glue can be used in layers of a cushioning assembly manufactured as disclosed herein, but preferably is not used in the pocketed spring cushioning unit layer(s) assembled using thermal welds.

Welding together of rows of pocketed spring modules 102 using probes and anvils inserted into module 106 central openings 120, pressing pocket fabric between them, and heating pocket fabric to form a polymer weld is disclosed by U.S. Pat. No. 9,221,670 (which also discloses use of vibrational, inductive or ohmic (Joule) heating), which is incorporated herein by reference. Use of wires (configured for Joule heating) recessed into channels in probes, into which anvils press pocket fabric to be heated and welded together, is disclosed by U.S. Pat. No. 9,427,092, which is incorporated herein by reference.

As used herein, "automatic" preferably refers to process performance without requiring human intervention except for ordinary installation, initial startup activity and ordinary maintenance. (In some embodiments, initial startup activity occurs which involves manual intervention by an operator or mechanic, e.g., daily, per-shift and/or per-on/off assembler power cycle, or for assembler debugging or other maintenance.)

As used herein, the "front" of a cushioning unit assembler 100 refers to the side of a cushioning unit assembler 100 into which a row of modules 102 is loaded, and the "rear" of a cushioning unit assembler 100 refers to the side of the cushioning unit assembler 100 from which a completed cushioning unit is removed.

FIG. 1A schematically shows an example of a pocketed spring cushioning unit assembler 100. FIG. 1B schematically shows an example of a row of pocketed spring modules 102. Rows of pocketed spring modules 102 are loaded onto the assembler 100 one at a time. As shown in FIG. 1, a row of modules 102 is preferably loaded from left to right along a long axis 104 of the row of modules 102, and is then preferably moved from front to rear to position the row of modules 102 for a welding cycle.

With respect to the individual modules 106 in a row of modules 102, the first two modules 108 to enter the assembler 100 are called the "front modules" 108 herein.

Preferably, a conveyor belt 110 is used to load the row of modules 102 onto the assembler 100, and moves right-ward to do so. The conveyor belt 110 can, for example, be used to transport a just-completed row of modules 102 from a pocketed spring module assembler (not shown) to the cushioning unit assembler 100.

Prior to reaching the cushioning unit assembler 100, a row of modules 102 is preferably held on the conveyor belt 110 by fixed barriers (e.g., walls or rails) on the front and rear sides of the conveyor belt 110. Once the row of modules 102 reaches the cushioning unit assembler 100, the row of modules 102 is preferably prevented from moving rear-ward by a guide wall 112 on one side, and positioning rods 114 and an insertion frame 116 on the other side. Positioning rods 114 are mounted on and extend from the insertion frame 116 (the insertion frame 116 is shown in and further described with respect to FIG. 4). The guide wall 112 is parallel and adjacent to the conveyor belt 110, and starts in a vertically-oriented position. The guide wall 112 is hinged to lie flat—i.e., change to a horizontally-oriented position—to allow the row of modules 102 to move rear-ward to be positioned for a welding cycle.

Positioning rods 114 preferably have rollers on their ends to facilitate entry of the row of modules 102 onto the cushioning unit assembler 100.

Preferably, there is a stop 140 mounted on the cushioning unit assembler 100 to halt the row of modules 102 in a fixed and known position. The stop 140 can be, for example, a right-most positioning rod 114 (as shown), or a plate, wall or horizontal or vertical rod orthogonal to the axis along which the row of modules 102 entered the cushioning unit assembler 100. Preferably, the stop 140 is located on the right side of the cushioning unit assembler 100, opposite where the row of modules 102 enters, and is located to halt the row of modules 102 in a position such that a first positioning rod 118 extended from the insertion frame 116 will insert directly into the indentation between the front modules 108 (further described with respect to FIG. 3A). As shown, where the stop 140 is a right-most positioning rod 114, the first positioning rod 118 is a second-from-the-right positioning rod 114.

Once the first positioning rod 118 is inserted into the gap between the front modules 108, the conveyor belt 110 reverses its direction of movement to apply tension to the row of modules 102. That is, the conveyor belt 110 moves right-ward to load the row of modules 102 onto the assembler 100; and the conveyor belt 110 moves left-ward to apply tension to the row of modules 102. The first positioning rod 118 is large enough that it holds in place the first module 106 to enter the assembler 100. As a result, the reversed conveyor belt 110 applies tension to the row of modules 102 (particularly the second and later modules 106 to enter the assembler 100), stretching the row of modules 102 and increasing the aperture size of the modules' 106 central openings 120.

Figure 3A:
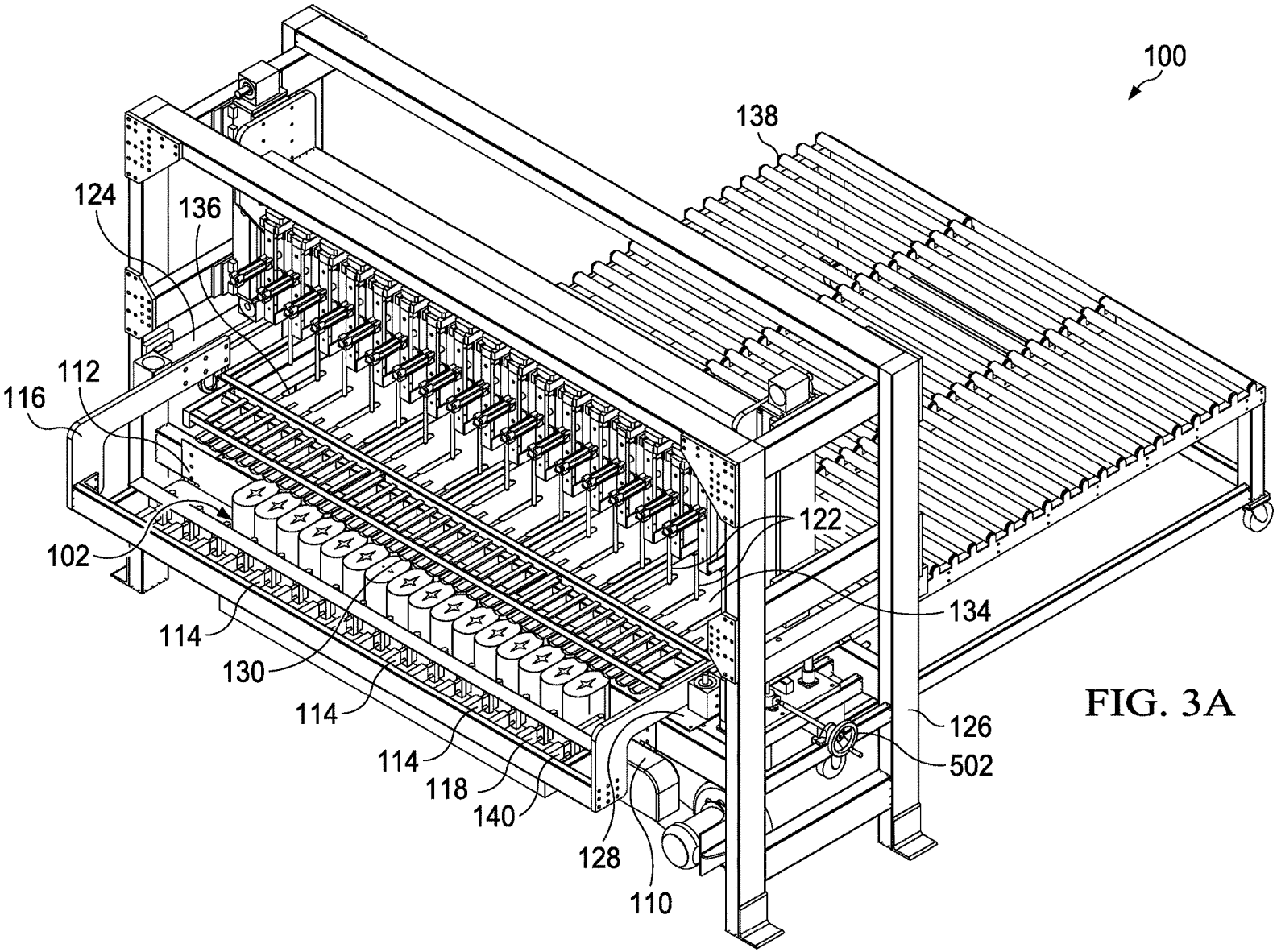
FIG. 3A schematically shows an example of a pocketed spring cushioning unit assembler assembling a cushioning unit.
Figure 3B:
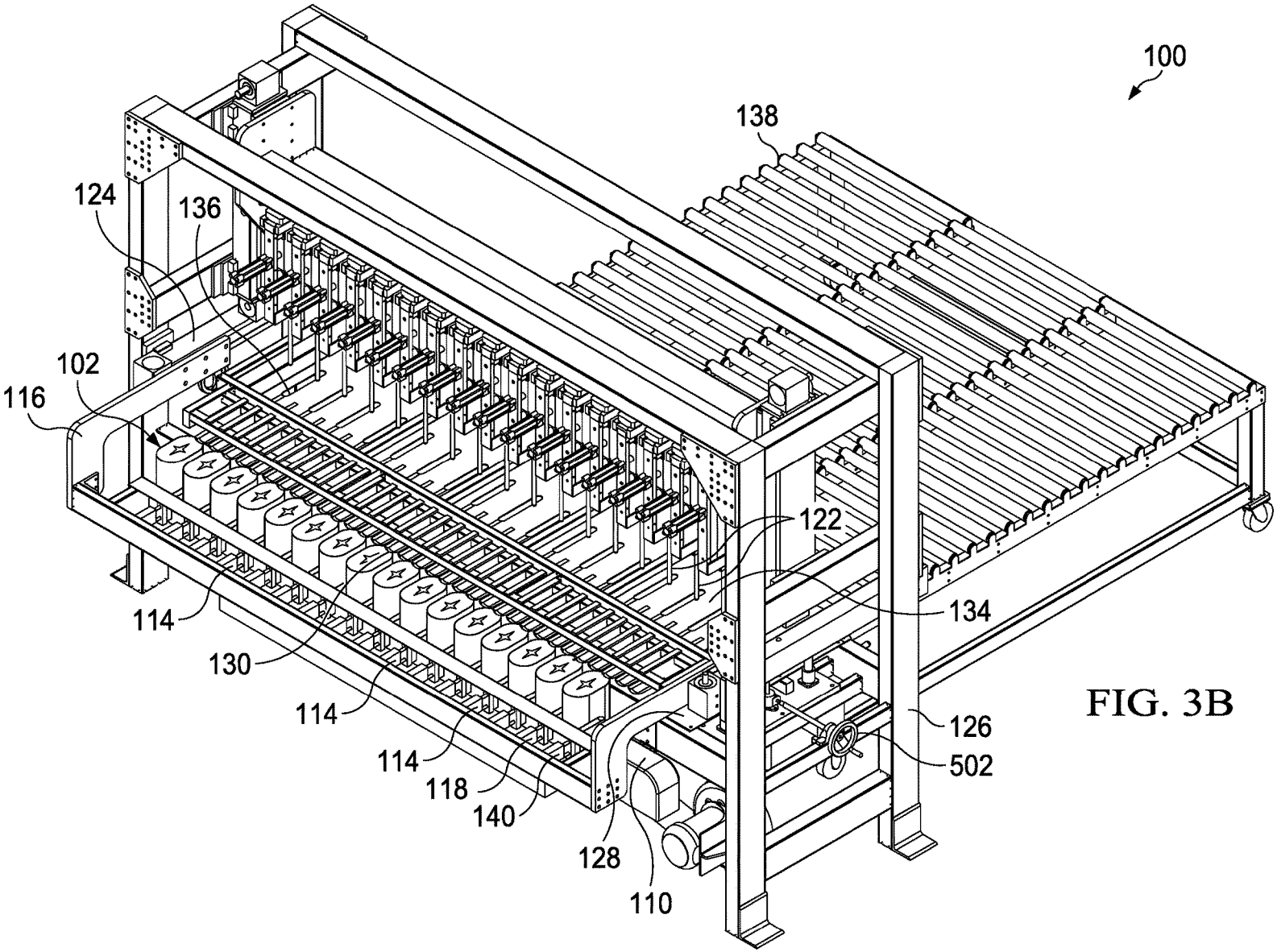
FIG. 3B schematically shows an example of a pocketed spring cushioning unit assembler assembling a cushioning unit.

Once the conveyor belt 110 has stretched the row of modules 102, the rest of the positioning rods 114 extend into the gaps between other pairs of modules 106 in the row of modules 102 (as shown in and further described with respect to FIG. 3B). As a result, the modules 106 in the row of modules 102 are held in position (relative to each other and with respect to the direction of the long axis 104 of the row of modules 102) with enlarged central openings 120. Preferably, remaining positioning rods 114 are extended from the insertion frame 116 serially to maintain tension on the row of modules 102 while the positioning rods 114 are being extended. That is, positioning rod 114 extension preferably continues with the positioning rod 114 immediately to the left (adjacent to) the first positioning rod 118, and sequentially adjacent positioning rods 114 (to the left) are sequentially extended. Positioning rods 114 preferably have the same separation as welding phalanges 122, and are located such that, when central openings 120 of modules 106 are held in relative position by positioning rods 114, the central openings 120 are located on the planes defined by matched pairs of welding phalanges 122 (pairs of welding phalanges 122 that close together to weld).

Stretching the row of modules 102 and fixing them in relative position assists in positioning the row of modules 102 in horizontal alignment with welding phalanges 122. Enlarging central openings 120 of the modules 106 gives greater tolerance in later vertical alignment of welding phalanges 122 with, and insertion of welding phalanges 122 into, central openings 120 of modules 106. Enlarged central openings 120 make it more likely that welding phalanges 122 will insert into central openings 120 accurately and without tearing module 106 spring pocket fabric.

The insertion frame 116 is mounted on motorized rails 124 (or other transport system), which are themselves mounted on the frame 126 of the cushioning unit assembler 100. Motorized rails move the insertion frame 116 towards and away from the welding phalanges 122, i.e., rear-ward and front-ward, respectively. Preferably, the insertion frame 116 spans the width (left-right) of the cushioning unit assembler 100.

Once positioning rods 114 are extended into the indentations between the modules 106 in the row of modules 102, the guide wall 112 lies flat, i.e., horizontally, preferably flush with the cushioning unit assembler's 100 surface plane 128. This enables the row of modules 102 to be moved towards the welding phalanges 122.

The insertion frame 116 (that is, for example, the module-facing side of the insertion frame 116, the positioning rods 114 mounted on the insertion frame 116, or both) pushes the row of modules 102 towards the welding phalanges 122. In the course of this travel, the row of modules 102 is pushed between upper guide wedges 130 and lower guide wedges 132 (upper guide wedges 130 and lower guide wedges 132 preferably taper from a rear-ward end to a front-ward end of the cushioning unit assembler 100, as well as towards a module-facing surface or edge), which press between adjacent pocketed springs within a module 106, assisting both in maintaining relative position of modules 106 and in enlarging central openings 120.

The row of modules 102 is also pushed under a compression plate 134. The space between the surface plane 128 and the compression plate 134 is less than the uncompressed height of the row of modules 102. As a result, when the insertion frame 116 pushes the row of modules 102 under the compression plate 134, the compression plate 134 compresses the row of modules 102 (including the springs therein). The compression plate 134 preferably has a lip that ramps closer to the surface plane 128 in the rear-ward direction, so that the row of modules 102 is gradually compressed, and to prevent an edge of the compression plate 134 from catching on (and potentially tearing) pocket fabric. This assists in preventing relative movement of modules 106 within the row of modules 102, and in generally preventing movement of the row of modules 102 not caused by movement of the insertion frame 116.

The cushioning unit assembler 100 preferably has two rows of welding phalanges 122, preferably comprising a row of probes and a row of anvils. Welding phalanges 122 have an axis of insertion, i.e., the path they follow into central openings 120 of modules 106 (or when welding phalanges 122 are otherwise lowered). The axis of insertion of a welding phalange 122 (e.g., a single probe or anvil) is preferably the same as (or can be regarded as a linear extension of) the long axis of the welding phalange 122.

Not all welding phalanges 122 need to be used during a welding cycle. For example, welding phalanges 122 can be configured so that some welding phalanges 122 are not activated to cause a weld to form. Also, there can be fewer modules 106 in a row of modules 102 than there are welding phalanges 122 in the rows of welding phalanges 122.

The insertion frame 116 continues to push the row of modules 102 under the compression plate 134 until the row of modules 102 contacts the next-most-recently loaded row of modules 102.

At this point, if two or more rows of modules 102 have previously been loaded for construction of a cushioning unit currently being fabricated, then there are rows of modules 102 under both rows of welding phalanges 122, and the pairs of welding phalanges 122 (e.g., paired probes and anvils) are closed together, holding layers of thermally welded fabric together so that the welds can cool and set and will not pull apart when the pairs of welding phalanges 122 are separated.

Once the row of modules 102 contacts the next-most-recently loaded row of modules 102, the pairs of welding phalanges 122 separate and are lifted out of the central openings 120. The insertion frame 116 then pushes the row of modules 102 under the front-ward row of welding phalanges 122 so that the long axis of the central openings 120 of the row of modules 102 is aligned with the long axis (the axis of insertion) of the front-ward row of welding phalanges 122 (as shown in and further described with respect to FIG. 3C). This causes the row of modules 102 to push the next-most-recently loaded row of modules 102 so that the long axis of the central openings 120 of the next-most-recently loaded row of modules 102 is aligned with the long axis (the axis of insertion) of the rear-ward row of welding phalanges 122.

Once the most recently and next-most-recently loaded rows of modules 102 are thus aligned, the welding phalanges 122 are inserted (lowered) into the central openings 120 in the rows of modules 102. The welding phalanges 122 extend through holes 136 in the compression plate 134 to insert into the central openings 120 of the modules 106 (as shown in and further described with respect to FIG. 3D).

The pairs of welding phalanges 122 (e.g., probes and anvils, preferably comprising a row of probes paired with a row of anvils) are then closed together, and a welding pulse is applied to the welding phalanges 122 (e.g., current is applied to the probes) to heat the pocket fabric pressed between the pairs of welding phalanges 122 sufficiently to cause thermal welds to form. Preferably, the welding phalanges 122 are held together until the weld cools (and sets) sufficiently that it will not break when the pairs of welding phalanges 122 are separated (opened); and until a new row of modules 102 is in contact with welded rows of modules 102, which prevents separating welding phalanges 122 from pulling rows of modules 102 apart.

The same process can be performed on the first row of modules 102 in a cushioning unit, except that the welding cycle can be omitted (e.g., if it follows a completed cushioning unit).

Repeating this process enables automatic fabrication of a completed cushioning unit.

A cushioning unit assembler 100 preferably comprises an exit table 138 (e.g., large enough to support a completed cushioning unit), which supports welded rows of modules 102 as they are successively pushed back by successively loaded rows of modules 102 advanced by the insertion frame 116.

Preferably, the compression plate 134 can be raised or lowered to accommodate differently sized springs (different spring lengths) using a crank 402. This enables the compression plate 134, for various spring sizes, to maintain sufficient force on modules 106 within rows of modules 102 to prevent movement of said modules 106 relative to each other and with respect to welding phalanges 122.

Figure 2:
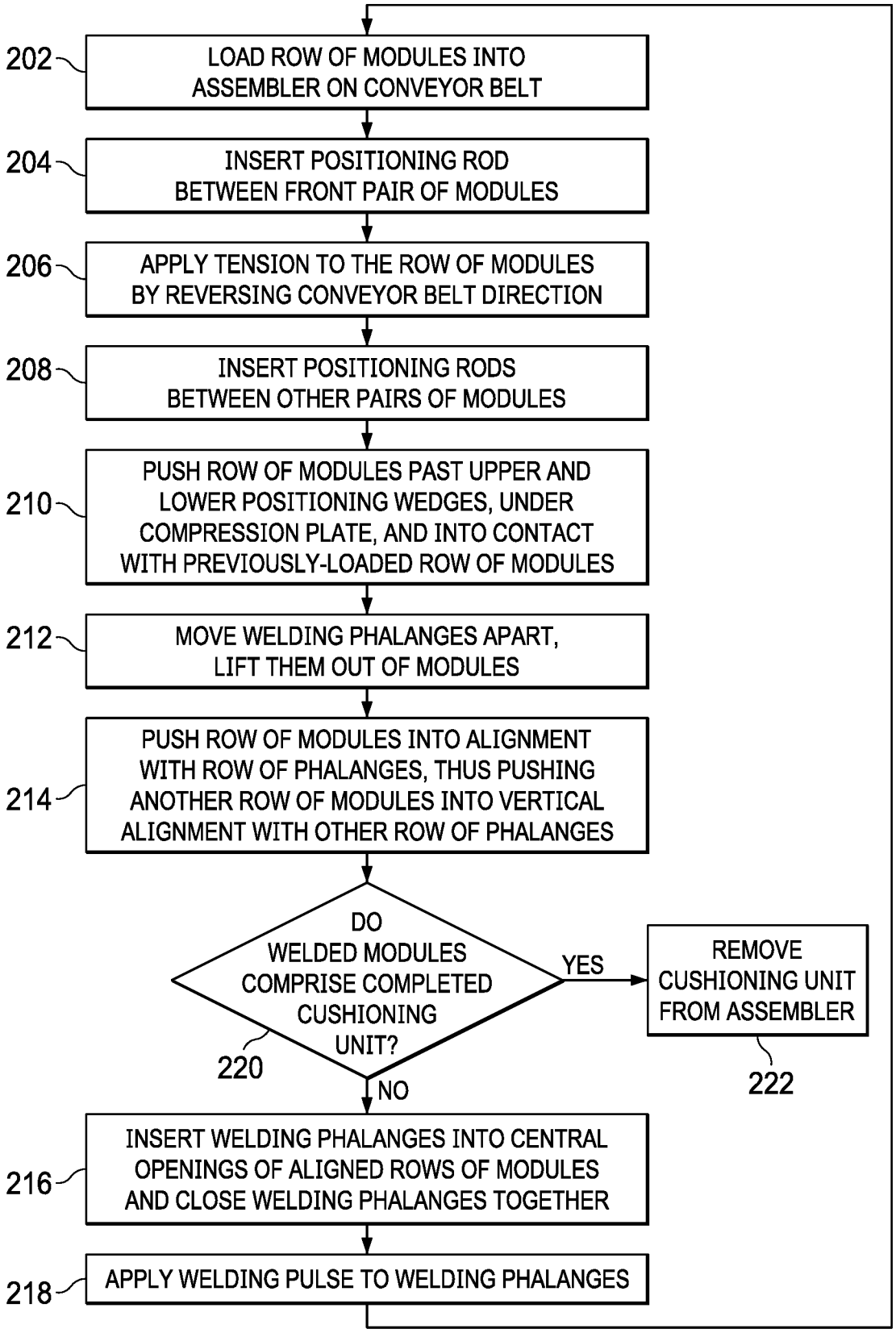
FIG. 2 shows an example process for welding rows of pocketed spring modules to each other.

FIG. 2 shows an example process for welding rows of pocketed spring modules to each other. As shown in FIG. 2, a loading and welding cycle, comprising a single row of modules 102 being loaded onto the cushioning unit assembler 100 and then welded onto one or more previously loaded (and, after the first two rows of modules 102 in a cushioning unit, previously welded) rows of modules 102, begins with a row of modules 102 being loaded onto the cushioning unit assembler 100 on the conveyor belt 110 in step 202. The first positioning rod 118 is then extended from the insertion frame 116 into the space between the front modules 108 in step 204. Tension is then applied to the modules 106 by reversing the direction of the conveyor belt 110 in step 206, thus separating the modules 106 in the row of modules 102 and enlarging their central openings 120. While the conveyor belt 110 is running in reverse (leftward), the remaining positioning rods 114 extend from the insertion frame 116 into the indentations between the other pairs of adjacent modules 106 in the row of modules 102 in step 208.

The row of modules 102 is then pushed (by the insertion frame 116) between upper and lower guide wedges 130 and 132 and under the compression plate 134 (such that the row of modules 102 is compressed by the compression plate 134), until the row of modules 102 contacts the next-most-recently loaded row of modules 102 in step 210. Such contact helps to hold just-created welds together when the welding phalanges 122 separate and lift out of central openings 120 in just-welded rows of modules 102 in step 212. The row of modules 102 is then pushed (by the insertion frame 116) so that the long axis of the central openings 120 of the row of modules 102 is aligned with the long axis of the front-ward row of welding phalanges 122 in step 214. This also results in the long axis of the central openings 120 of the next-most-recently loaded row of modules 102 being aligned with the long axis of the rear-ward row of welding phalanges 122.

The rows of welding phalanges 122 are then inserted into the central openings 120 of the currently-aligned rows of modules 102 and closed together in step 216 (in preferred embodiments, this causes anvils to press fabric from modules 106 in both currently-aligned rows of modules 102 into the channels of probes), and a welding pulse is applied to the welding phalanges 122 in step 218 (e.g., in preferred embodiments, current is applied to the wires in channels of probes, causing the wires to heat proximate pocket fabric (pressed into the channels) to form welds).

If, after step 214 (or in some embodiments, step 212), the previously-welded rows of modules 102 comprise a completed cushioning unit (step 220), the completed cushioning unit is removed from the cushioning unit assembler 100 in step 222, and the process returns to step 202 (skipping steps 216 and 218—i.e., the welding cycle—with respect to the just-loaded row of modules 102, which is now alone on the cushioning unit assembler 100).

In some embodiments, removal of the completed cushioning unit (step 222) is performed after a second row of modules 102 undergoes the loading and welding process, e.g., through step 214. This can be advantageous, e.g., allowing the completed cushioning unit to be pushed out from under the compression plate 134 and/or out from between upper guide wedges 130 and lower guide wedges 132.

FIG. 3A schematically shows an example of a pocketed spring cushioning unit assembler 100 assembling a cushioning unit. As shown in FIG. 3A, a row of modules 102 has entered the assembler 100 on the conveyer belt 110, and has been stopped by the stop 140, which has extended from the insertion frame 116.

FIG. 3B schematically shows an example of a pocketed spring cushioning unit assembler 100 assembling a cushioning unit. As shown in FIG. 3B, following FIG. 3A, after the first positioning rod 118 extended between the front modules 108 to hold a right-most module in place, the conveyer belt 110 reversed to stretch the row of modules 102, and the rest of the positioning rods 118 sequentially extended to hold the modules 106 in relative position and align the center openings 120 with the welding phalanges 122.

Figure 3C:
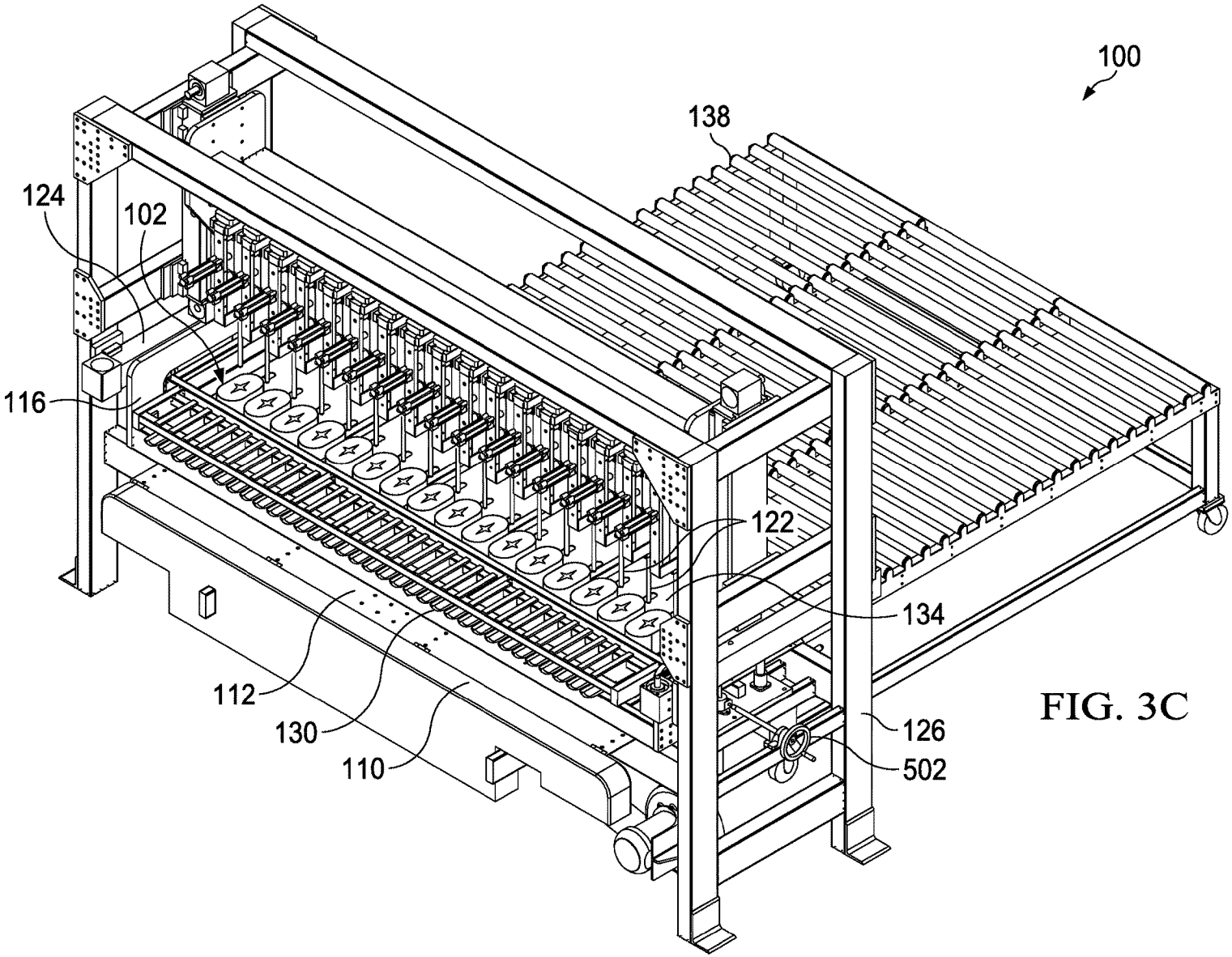
FIG. 3C schematically shows an example of a pocketed spring cushioning unit assembler assembling a cushioning unit.

FIG. 3C schematically shows an example of a pocketed spring cushioning unit assembler 100 assembling a cushioning unit. In FIG. 3C, the compression plate 134 is made invisible to reveal the progress of the row of modules 102, and only the most-recently-inserted row of modules 102 is shown. As shown in FIG. 3C, following FIG. 3B, after the guide wall 112 laid flat, the insertion frame 116 pushed the row of modules 102 between the upper and lower guide wedges 130, 132, and under the compression plate 134, so that the central openings 120 of the row of modules 102 are vertically aligned with a row of welding phalanges 122.

Figure 3D:
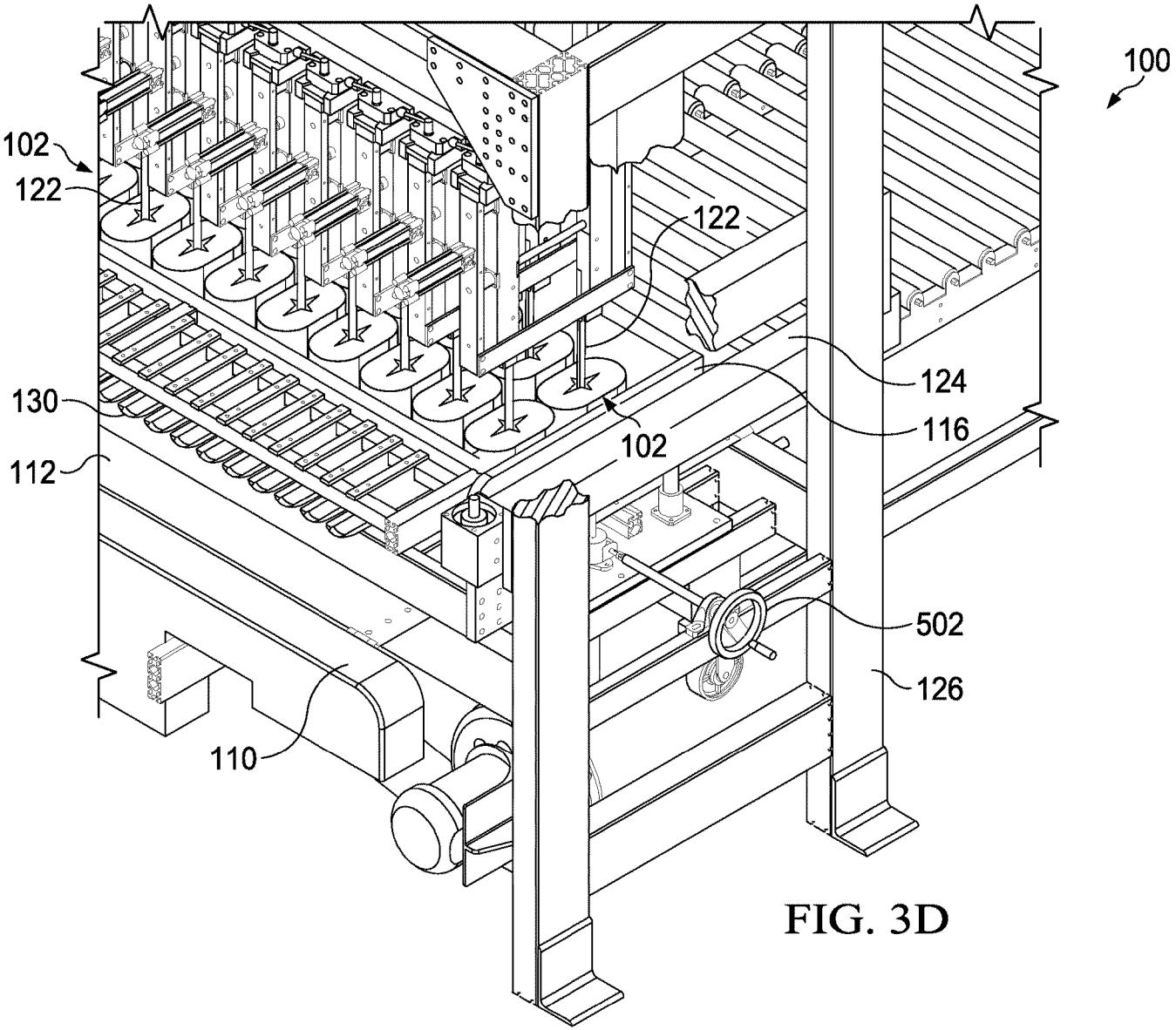
FIG. 3D schematically shows an example of a close-up view of a pocketed spring cushioning unit assembler assembling a cushioning unit.

FIG. 3D schematically shows an example of a close-up view of a pocketed spring cushioning unit assembler 100 assembling a cushioning unit. As shown in FIG. 3D, following FIG. 3C, the welding phalanges 122 are inserted into the central openings 120 in the row of modules 102 and a previously-inserted row of modules 102. Subsequently, the welding phalanges 122 will close to weld the rows of modules 102 together.

Figure 4:
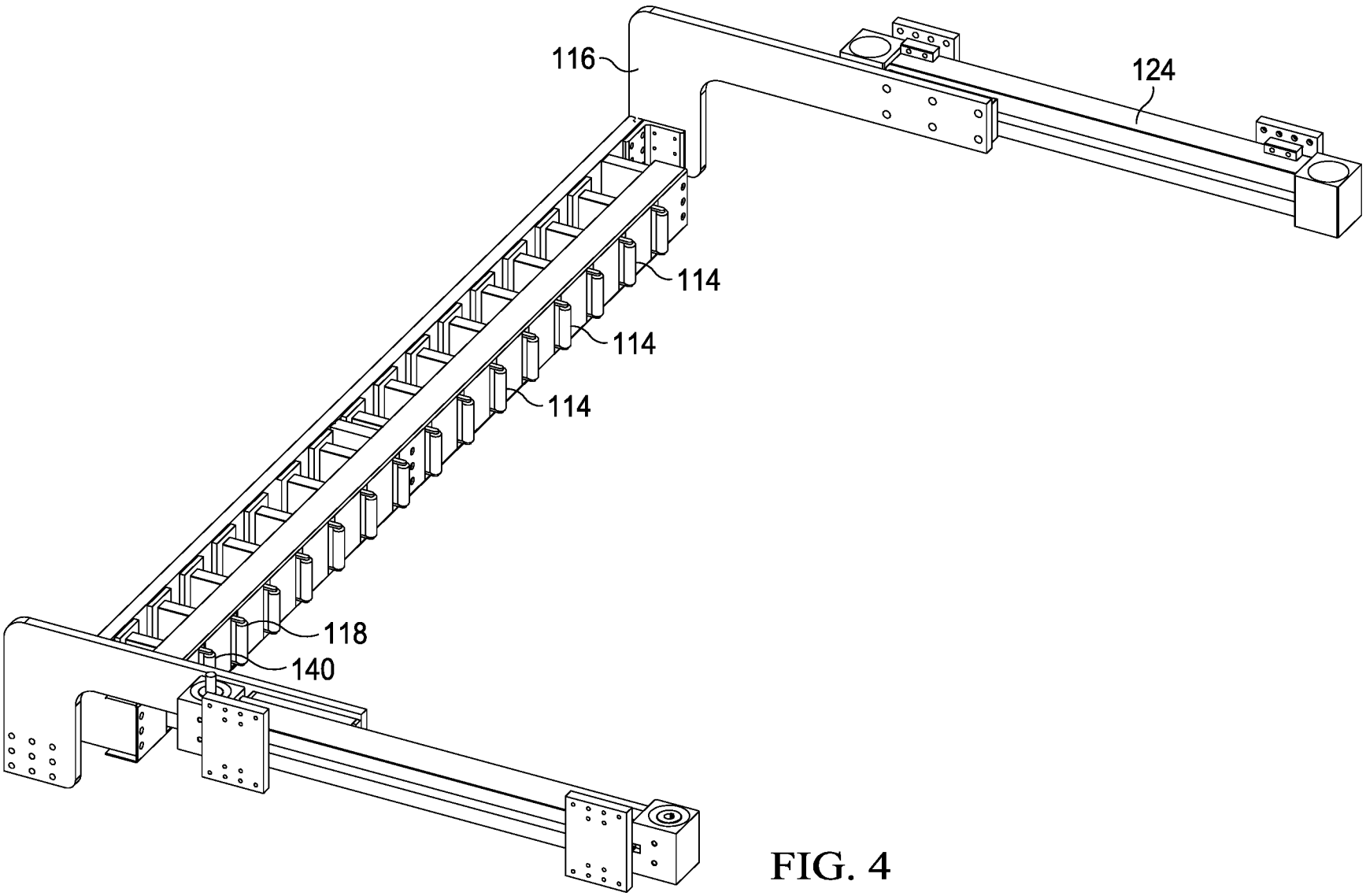
FIG. 4 schematically shows an example of an insertion frame from a machine for welding rows of pocketed spring modules to each other.

FIG. 4 schematically shows an example of an insertion frame 116. An insertion frame preferably includes a row of extendible (e.g., using hydraulic actuators) positioning rods 114; a first positioning rod 118 to be inserted into the space between the front modules 106 in rows of modules; and motorized rails 124 for moving the insertion frame, and the positioning rods 114 mounted thereon, towards the welding phalanges 122 (rear-ward).

Figure 5:
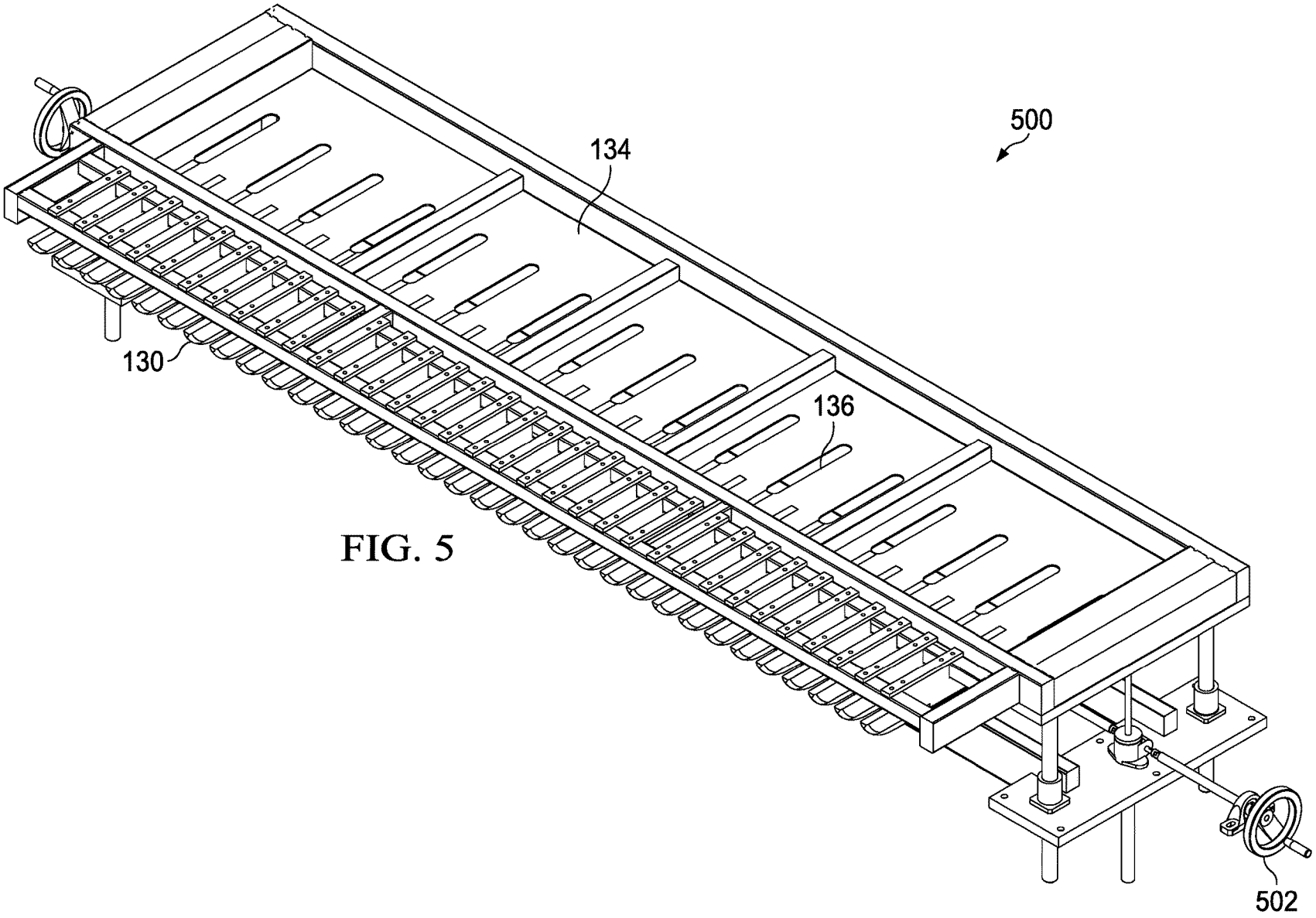
FIG. 5 schematically shows an example of an upper alignment unit from a machine for welding rows of pocketed spring modules to each other.

FIG. 5 schematically shows an example of an upper alignment unit 500 from a cushioning unit assembler 100. An upper alignment unit 500 includes upper guide wedges 130 shaped and located to help guide a main axis of pocketed spring-surrounded module 106 central openings 120 (generally a vertical axis in embodiments as shown) into alignment with welding phalanges 122 in a row of welding phalanges 122 to enable insertion (preferably using linear vertical motion) of the welding phalanges 122 into the central openings 120. Welding phalanges 122 are inserted through holes 136 in a compression plate 134. The compression plate 134 compresses springs in modules 106 and uses resulting friction to hold modules 106 in relative position with respect to other modules 106 in the same row of modules 102 and with respect to the welding phalanges 122. The compression plate 134 can be raised or lowered using a handle 502 to accommodate differently sized springs.

Figure 6:
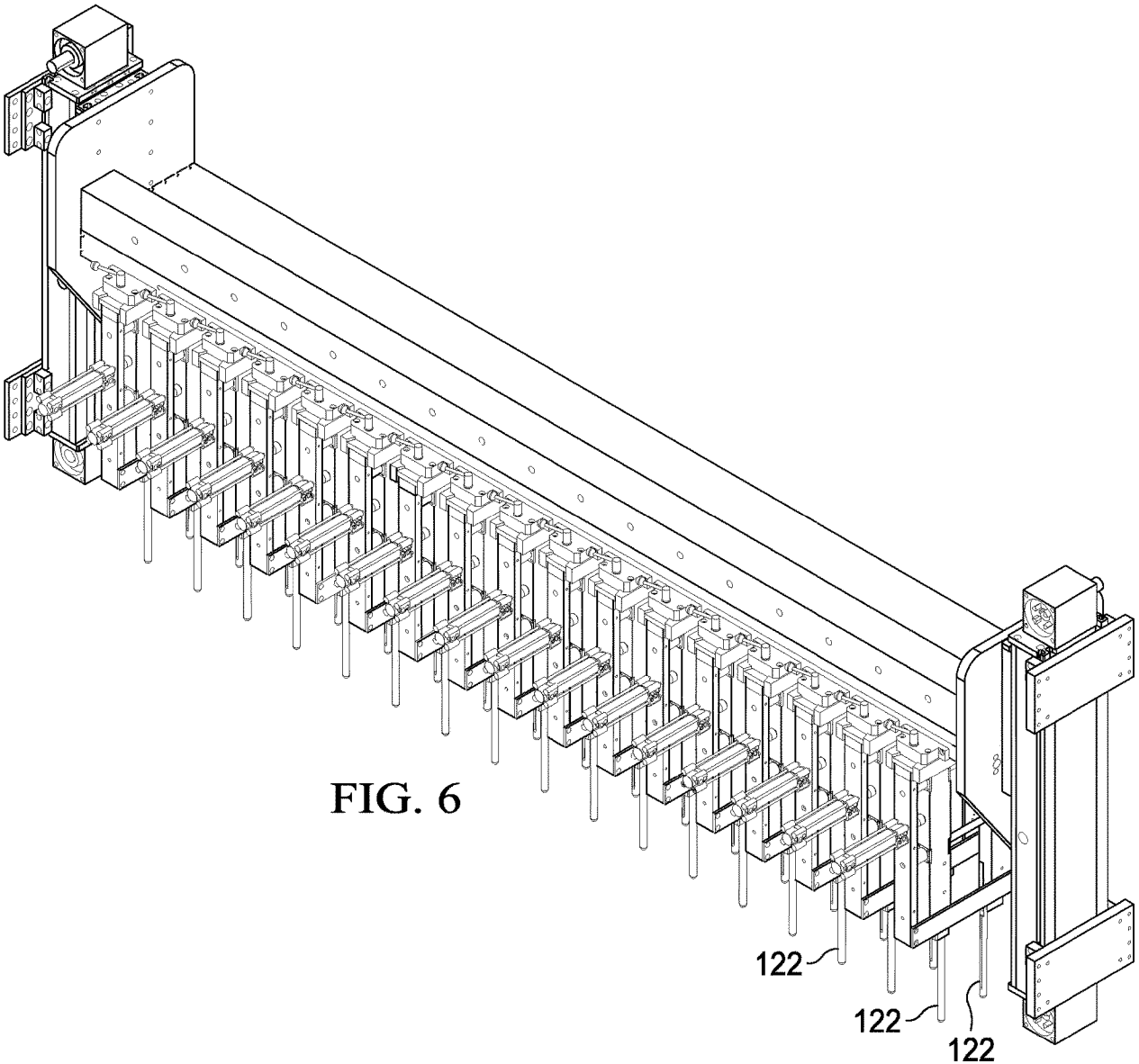
FIG. 6 schematically shows an example of a sealing head from a machine for welding rows of pocketed spring modules to each other.

FIG. 6 schematically shows an example of a sealing head 600 for welding rows of pocketed spring modules 102 to each other. Welding phalanges 122 are preferably organized into a double row of probe/anvil pairs configured to insert into module openings 120 using a rail (or other motive) system to which the welding phalanges 122 are attached. Pairs of welding phalanges 122 are configured to press together with pocket fabric between, and to cause a polymer weld to form when a welding pulse is passed through one or both of the welding phalanges 122 (causing, e.g., acoustic, inductive or ohmic/Joule heating). Welding phalanges 122 are mounted on a power source, preferably a modular power source that can be removed for easy, fast, inexpensive maintenance.

Figure 7:
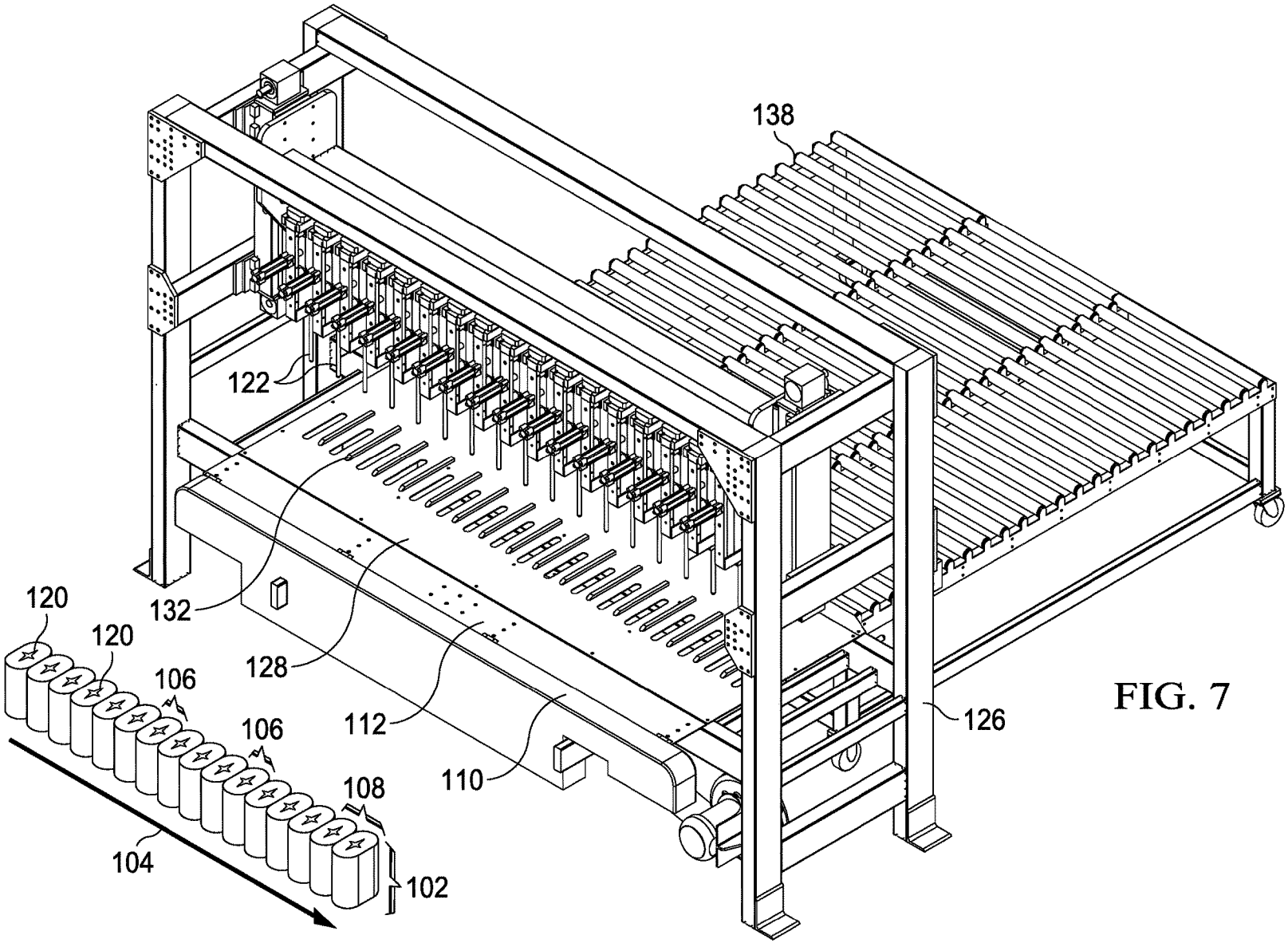
FIG. 7 schematically shows an example of a frame and sealing head from a machine for welding rows of pocketed spring modules to each other.

FIG. 7 schematically shows an example of the frame and sealing head of a cushioning unit assembler 100. A conveyor belt 110 is used to load rows of modules 102 onto the cushioning unit assembler. The guide wall 112 holds a row of modules 102 in position while positioning rods 114 are extended into spaces between modules 106, and lies flat while the row of modules 102 is being moved towards the welding phalanges 122. Lower guide wedges 132 assist in guiding a row of modules 102 into alignment with a row of welding phalanges 122, and can be used to prevent relative motion of the modules 102 during insertion of and welding using welding phalanges 122. An exit table 138 is used to support rows of modules 102 after they have had two rows of modules 102 welded thereto (and generally to support portions of a cushioning unit that have completed the loading and welding process).

MODIFICATIONS AND VARIATIONS

As will be recognized by those skilled in the art, the innovative concepts described in the present application can be modified and varied over a tremendous range of applications, and accordingly the scope of patented subject matter is not limited by any of the specific exemplary teachings given. It is intended to embrace all such alternatives, modifications and variations that fall within the spirit and broad scope of the appended claims.

In some embodiments, rows of modules are loaded onto an assembler in a direction other than left to right. In some embodiments, movement of a row of modules through an assembler is oriented other than horizontally.

In some embodiments, transportation other than a conveyor belt (e.g., one or more of a gripping arm, pushing arm or pulling arm, gravity feed, or pegs inserted into module openings and moving along a rail) is used to load rows of modules onto the assembler. In some embodiments, a gripping arm, one or more pegs inserted into central openings, or other means of applying tension to a row of modules is used to align module openings with welding phalanges (stretching the row of modules and enlarging central openings) and/or prepare the row of modules for insertion of positioning rods. Those of ordinary skill in the arts of machine engineering of industrial machines will understand that other means of transport and applying tension can be used to load and stretch a row of modules (e.g., to enable appropriate placement of positioning rods).

In some embodiments, the compression plate is parallel to the surface plane of the cushioning unit assembler. In some embodiments, the compression plate gets closer to the surface plane as it approaches the welding phalanges. In some embodiments, the compression plate continues to get closer to the surface plane past one or both welding phalanges.

In some embodiments, both of a pair of welding phalanges move to close the pair of welding phalanges together. In some embodiments, only one of a pair of welding phalanges moves to close the pair of welding phalanges together.

In some embodiments, welds that come apart after the welding phalanges separate can be repaired, e.g., using a handheld polymer welding tool, or a portable or individually mounted pair of welding phalanges.

In some embodiments, welded-together pairs of rows of modules can be clamped together, before and/or during and/or after a welding cycle, to give welds additional time to cool and set.

In some embodiments, once the guide wall lies flat, the guide wall remains lying flat until the insertion frame returns to its original position.

In some embodiments, a first positioning rod is extended into the space between a pair of adjacent modules that are not at an end of the row of modules, and tension is applied in both directions (simultaneously or sequentially) to stretch the row of modules into position for insertion of the remaining positioning rods.

In some embodiments, upper guide wedges protrude through the compression plate and continue to assist in positioning the row of modules once the row of modules is compressed by the compression plate.

In some embodiments, the coil diameters and/or module sizes supported by a cushioning unit assembler can be adjusted.

In some embodiments, the distances between adjacent upper guide wedges are adjustable. In some embodiments, the distances between adjacent lower guide wedges or retaining bumps are adjustable.

In some embodiments, a row of modules is loaded to a predetermined stop point such that the gap between the first-loaded module and the next-loaded module in the row of modules is aligned with a first positioning rod. In some embodiments, the predetermined stop point can be adjusted, e.g., for different sized modules and/or for different spacing between modules.

In some embodiments, a row of modules is caused to pause at a predetermined stop point using one or more of timing, sensing the location of the row of modules (e.g., using pressure, an optical sensor, or switches tripped by passage of the row of modules), structure on the conveyor belt (or other transportation), e.g., locator prongs or bumps that contact or are inserted into central openings or indentations in pocket fabric at spring centers, or using pressure sensors on positioning rods and conveyor belt. Those of ordinary skill in the arts of machine engineering of industrial machines will understand that other positioning methods can be used.

In some embodiments, spacing between adjacent positioning rods can be adjusted. In some embodiments, spacing between adjacent welding phalanges in a row of welding phalanges can be adjusted.

Though embodiments described above use a compression plate, those of ordinary skill in the arts of machine engineering of industrial machines will understand that other shapes (e.g, a lattice, or fingers parallel to the axis of movement of the modules) can be used to apply friction and/or pressure to rows of modules to maintain relative spacing of modules during loading and welding.

In some embodiments, a last-loaded module in a row of modules is held in place (e.g., by a positioning rod); the conveyor belt moves forward (in the same direction by which the row of modules was loaded onto the cushioning unit assembler) to apply tension to the row of modules; and the remaining positioning rods are inserted between pairs of adjacent modules in reverse sequential order to the order in which they entered the cushioning unit assembler.

In some embodiments, positioning rods are inserted between modules substantially simultaneously, and then moved apart to position modules.

Ones of ordinary skill in the art of machine engineering of manufacturing machinery will understand that other arrangements and combinations of positioning rods and conveyor belt can be used to hold, push, stretch and apply tension to modules to move openings of the modules (in a row of modules) into alignment, or enable them to be moved into alignment (e.g., pushed by a pusher plate), with a corresponding axis of members of a row of probes and/or anvils (welding phalanges).

In some embodiments, motorized rolling rods can be used instead of a conveyor belt.

In some embodiments, the table on which the rows of modules sit can be configured to lift to cause insertion of welding phalanges into central openings.

In some embodiments, positioning rods are inserted between each adjacent pair of modules in a row of modules. In some embodiments, positioning rods are inserted between multiple, but not all, adjacent pairs of modules in a row of modules.

In some embodiments, ultrasonic vibrations are used to cause welding of pocket fabric. In some embodiments, induction heating can be used to provide localized spot heating—and hence, under pressure, welding—of the two layers of flexible material which are being held together by the probe and anvil. In some embodiments, the probe and anvil can be used as conductors for simple ohmic heating. In some embodiments, the location where the probe and anvil have pinched two layers of flexible material between them can be analyzed as a metal-insulator-metal (MIM) capacitor, and superficial modification can be performed to generate localized ohmic heating at the contact areas of the probe and/or anvil.

According to some but not necessarily all embodiments, there is provided: A method for assembling a cushioning unit, comprising the steps of: wherein individual pocketed spring modules comprise more than two pocketed springs which together surround an opening, a) automatically aligning, using multiple positioning rods inserted between pairs of adjacent ones of said modules in a linearly connected row of said modules, a main axis of said openings of said row of modules with a main axis of welding phalanges in a row of welding phalanges; b) inserting said welding phalanges into said aligned openings, and inserting another row of welding phalanges into said openings of another row of modules which is adjacent and parallel to said row of modules; and c) closing together said rows of welding phalanges, and activating ones of said welding phalanges to thereby weld together said rows of modules.

According to some but not necessarily all embodiments, there is provided: A method for assembling a cushioning unit, comprising the steps of: wherein individual pocketed spring modules comprise more than two pocketed springs which together surround an opening, a) inserting a first positioning rod between a pair of adjacent ones of said modules in a linearly connected row of said modules; b) applying tension to said row of modules, and inserting positioning rods between multiple other pairs of adjacent ones of said modules in said row of modules; c) moving said row of modules, without removing said positioning rods from between said adjacent pairs of modules, to align a main axis of said openings with a main axis of welding phalanges of a row of welding phalanges; d) inserting said row of welding phalanges into said aligned openings, and inserting another row of welding phalanges into said openings of another row of modules which is adjacent and parallel to said row of modules; and e) moving said rows of welding phalanges together and applying a welding pulse to ones of said welding phalanges to thereby weld said rows of modules together; and f) repeating steps a) through e) to form a completed cushioning unit.

According to some but not necessarily all embodiments, there is provided: A method for assembling a cushioning unit, comprising the steps of: wherein individual pocketed spring modules comprise more than two pocketed springs which together surround and define an opening, a) activating a first and second row of welding phalanges, respectively inserted in said openings in first and another rows of modules and closed together, to weld together said first and another rows of modules; b) loading a second row of modules into parallel and adjacent contact with said first row of modules; c) after step b), separating said rows of welding phalanges and removing said welding phalanges from said first and another rows of modules; d) moving said second row of modules to enable insertion of said first row of welding phalanges into said openings in said second row of modules, and moving said first row of modules to enable insertion of said second row of welding phalanges into said openings in said first row of modules; and e) inserting said first row of welding phalanges into said openings in said second row of modules, and inserting said second row of welding phalanges into said openings of said first row of modules, and activating said welding phalanges to weld said first and second rows of modules together.

According to some but not necessarily all embodiments, there is provided: A cushioning unit assembler, comprising: wherein individual pocketed spring modules comprise more than two pocketed springs which together surround and define an opening, a module transporter configured to load a linearly connected row of said modules onto the assembler and to apply tension to said row of modules if one or more of said modules is fixed in position; an insertion frame, with multiple positioning rods mounted thereon, said positioning rods configured to be extended into spaces between adjacent pairs of modules, said insertion frame configured to move said row of modules into position for welding phalanges to be inserted into said openings in said row of modules; at least two rows of said welding phalanges configured to be inserted into said openings of respective rows of modules, adjacent pairs of said rows of welding phalanges configured to be inserted into said openings, to close together, and when so inserted and closed, to be activated to weld said respective rows of modules together.

Additional general background, which helps to show variations and implementations, may be found in the following publications, all of which are hereby incorporated by reference: U.S. Pat. Nos. 4,401,501; 6,131,892; 6,260,331; 6,347,423; 9,221,670; and 9,427,092.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A method for assembling a cushioning unit, comprising the steps of:

wherein individual pocketed spring modules comprise more than two pocketed springs which together surround an opening, a) automatically aligning, using multiple positioning rods inserted between pairs of adjacent ones of said modules in a linearly connected row of said modules while maintaining tension on said row of modules, a main axis of said openings of said row of modules with a main axis of welding phalanges in a row of welding phalanges;

b) inserting said welding phalanges into said aligned openings, and inserting another row of welding phalanges into said openings of another row of modules which is adjacent and parallel to said row of modules; and c) closing together said rows of welding phalanges, and activating ones of said welding phalanges to thereby weld together said rows of modules.

2. The method of claim 1, further comprising d) separating said welding phalanges and removing them from said rows of modules; and e) automatically aligning said main axis of said openings with a main axis of welding phalanges in said another row of welding phalanges.

3. The method of claim 2, further comprising repeating steps a) through e) to form a completed cushioning unit.

4. The method of claim 3, wherein, only for a first row of modules in the cushioning unit, steps b) and c) are skipped.

5. The method of claim 3, wherein performance of step a) directly causes performance of step e).

6. The method of claim 1, wherein said welding phalanges comprise probe and anvil pairs, with one member of each of said pairs in each of said rows of welding phalanges.

7. The method of claim 1, wherein said another row of welding phalanges is parallel and proximate to said row of welding phalanges.

8. The method of claim 1, wherein said rows of welding phalanges cause said welding using at least one of Joule heating, induction heating and vibrational heating.

9. A method for assembling a cushioning unit, comprising the steps of:

wherein individual pocketed spring modules comprise more than two pocketed springs which together surround an opening, a) inserting a first positioning rod between a pair of adjacent ones of said modules in a linearly connected row of said modules;

b) while applying tension to said row of modules, inserting positioning rods between multiple other pairs of adjacent ones of said modules in said row of modules;

c) moving said row of modules, without removing said positioning rods from between said adjacent pairs of modules, to align a main axis of said openings with a main axis of welding phalanges of a row of welding phalanges;

d) inserting said row of welding phalanges into said aligned openings, and inserting another row of welding phalanges into said openings of another row of modules which is adjacent and parallel to said row of modules; and e) moving said rows of welding phalanges together and applying a welding pulse to ones of said welding phalanges to thereby weld said rows of modules together; and f) repeating steps a) through e) to form a completed cushioning unit.

10. The method of claim 9, wherein during step c), said row of modules is moved under guide wedges oriented parallel to the direction of said movement, an edge of ones of said guide wedges being pushed by said movement between adjacent pairs of springs of modules in said row of modules and preventing lateral movement of said modules.

11. The method of claim 9, wherein during step c), said movement causes said row of modules to be pushed under and compressed by a compression plate, and wherein said compression plate prevents lateral movement of modules of said row of modules during steps c) and d).

12. The method of claim 9, further comprising, between steps e) and f), separating said welding phalanges and removing them from said rows of modules; and moving said row of modules to align said main axis of said openings with a main axis of welding phalanges in said another row of welding phalanges.

13. The method of claim 9, wherein, only for a first row of modules in the cushioning unit, steps d) and e) are skipped.

14. The method of claim 9, wherein said rows of welding phalanges cause said welding using at least one of Joule heating, induction heating and vibrational heating.

15. A method for assembling a cushioning unit, comprising the steps of:

wherein individual pocketed spring modules comprise more than two pocketed springs which together surround and define an opening, a) activating a first and second row of welding phalanges, respectively inserted in said openings in first and another rows of modules and closed together, to weld together said first and another rows of modules;

b) loading a second row of modules into parallel and adjacent contact with said first row of modules;

c) after step b), separating said rows of welding phalanges and removing said welding phalanges from said first and another rows of modules;

d) moving said second row of modules to enable insertion of said first row of welding phalanges into said openings in said second row of modules, and moving said first row of modules to enable insertion of said second row of welding phalanges into said openings in said first row of modules; and e) inserting said first row of welding phalanges into said openings in said second row of modules, and inserting said second row of welding phalanges into said openings of said first row of modules, and activating said welding phalanges to weld said first and second rows of modules together.

16. The method of claim 15, further comprising repeating steps a) through e) to form a completed cushioning unit.

17. The method of claim 15, wherein, only for an initial two rows of modules in the cushioning unit, steps a) and c) are skipped.

18. The method of claim 15, wherein said welding phalanges comprise probe and anvil pairs, with one member of each of said pairs in each of said rows of welding phalanges.

19. The method of claim 15, wherein said another row of welding phalanges is parallel and proximate to said row of welding phalanges.

20. The method of claim 15, wherein said rows of welding phalanges cause said welding using at least one of Joule heating, induction heating and vibrational heating.

* * * * *